US010653213B2

(12) United States Patent
Kojima et al.

(10) Patent No.: US 10,653,213 B2
(45) Date of Patent: May 19, 2020

(54) SLIDER AND SLIDE FASTENER

(71) Applicant: YKK Corporation, Tokyo (JP)

(72) Inventors: Masayoshi Kojima, Kurobe (JP); Hideki Sato, Kurobe (JP); Takayuki Inukai, Kurobe (JP)

(73) Assignee: YKK Corporation (JP)

( * ) Notice: Subject to any disclaimer, the term of this patent is extended or adjusted under 35 U.S.C. 154(b) by 0 days.

(21) Appl. No.: 16/336,054

(22) PCT Filed: Sep. 26, 2016

(86) PCT No.: PCT/JP2016/078253
§ 371 (c)(1),
(2) Date: Mar. 22, 2019

(87) PCT Pub. No.: WO2018/055760
PCT Pub. Date: Mar. 29, 2018

(65) Prior Publication Data

US 2019/0223561 A1 Jul. 25, 2019

(51) Int. Cl.
*A44B 19/26* (2006.01)
*A44B 19/28* (2006.01)

(52) U.S. Cl.
CPC ..... *A44B 19/262* (2013.01); *A44B 19/28* (2013.01)

(58) Field of Classification Search
CPC ..... A44B 19/262; A44B 19/28; A44B 19/26; Y10T 24/2561; Y10T 24/2582; Y10T 24/2584
See application file for complete search history.

(56) References Cited

U.S. PATENT DOCUMENTS 3,284,864 A * 11/1966 Howell ..... A44B 19/308 24/424
8,225,466 B2 * 7/2012 Takani ..... A44B 19/26 24/415

(Continued)

FOREIGN PATENT DOCUMENTS

JP 2009-273852 A 11/2009
JP 3193160 U 9/2014

(Continued)

OTHER PUBLICATIONS

International Preliminary Report on Patentability, PCT Patent Application No. PCT/JP2016/078253, dated Mar. 26, 2019.

(Continued)

*Primary Examiner* — Robert Sandy
*Assistant Examiner* — Rowland Do
(74) *Attorney, Agent, or Firm* — Kilpatrick Townsend & Stockton LLP

(57) ABSTRACT

A slider includes a slider body and a pull. The slider body includes an upper blade and a lower blade arranged to be spaced from each other in an up-down direction and to be parallel to each other, a guide post connecting the upper blade and the lower blade, and a pull attachment portion provided on an upper surface of the upper blade. The pull is attached to the pull attachment portion. A cut-out portion is formed on a front end portion of the upper blade at one of left and right sides with respect to the guide post. The cut-out portion is formed to be positioned at a rear side than a front end portion of the upper blade at the other of the left and right sides with respect to the guide post and than a front end portion of the lower blade.

9 Claims, 18 Drawing Sheets

(56) References Cited

U.S. PATENT DOCUMENTS

| | | | | |
|---|---|---|---|---|
| 8,752,253 | B2 * | 6/2014 | Sato | A44B 19/28<br>24/386 |
| 2013/0139362 | A1 | 6/2013 | Sato | |
| 2013/0139363 | A1 | 6/2013 | Sato | |
| 2013/0139364 | A1 | 6/2013 | Sato | |
| 2013/0139365 | A1 | 6/2013 | Sato | |
| 2013/0232736 | A1 | 9/2013 | Sato | |

FOREIGN PATENT DOCUMENTS

| | | | |
|---|---|---|---|
| TW | 491036 | U | 6/2002 |
| WO | 2010-113281 | A1 | 10/2010 |
| WO | 2012-020587 | A1 | 2/2012 |

OTHER PUBLICATIONS

Office Action, Taiwanese Patent Application No. 106110759, dated Sep. 26, 2017.
Intenational Search Report, PCT Patent Application No. PCT/JP2016/078253, dated Dec. 20, 2016.
Written Opinion, PCT Patent Application No. PCT/JP2016/078253, dated Dec. 20, 2016.

* cited by examiner

SLIDER AND SLIDE FASTENER

TECHNICAL FIELD

The present invention relates to a slider and a slide fastener, and in particular to a slider and a slide fastener, in which a separable pin and elements can be simply inserted into the slider.

BACKGROUND ART

As conventional slide fasteners, a technique is known, in which a lower blade and a connecting post are configured to have an extended length in order to allow a separable pin to be simply inserted into a slider (e.g., see Patent Document 1).

CITATION LIST

Patent Document

Patent Document 1: Japanese Patent Application Publication No. 2009-273852

SUMMARY OF INVENTION

Problems to be Solved by Invention

However, the slider described in the above Patent Document 1 is increased in size and has a poor operability, since the connecting post and the lower blade have the extended length.

The present invention has been made keeping in mind the above problems, and an object thereof is to provide a slider and a slide fastener, in which a good operability is achieved while having a compact and simple structure and also a separable pin and elements can be simply inserted into the slider.

Means for Solving Problems

A slider according to one embodiment of the present invention includes:

a slider body including an upper blade and a lower blade arranged to be spaced from each other in an up-down direction and to be parallel to each other, a guide post connecting the upper blade and the lower blade, and a pull attachment portion provided on the upper surface of the upper blade; and a pull attached to the pull attachment portion, wherein a cut-out portion (51*b*) is formed on a front end portion of the upper blade at one of left and right sides with respect to the guide post, the cut-out portion is formed to be positioned at a rear side than a front end portion of the upper blade at on the other of the left and right sides with respect to the guide post and than a front end portion of the lower blade.

In the slider according to one embodiment of the present invention, a distance from a front end portion of the guide post to the cut-out portion of the upper blade is longer than a distance from the front end portion of the guide post to the front end portion of the lower blade.

In the slider according to one embodiment of the present invention, the distance from the front end portion of the guide post to the front end portion of the lower blade is zero.

In the slider according to one embodiment of the present invention, the cut-out portion is formed to extend from one lateral surface of the guide post toward the outside.

In the slider according to one embodiment of the present invention, the upper surface of the lower blade, on the side at which the cut-out portion is formed, is provided with an inclined portion formed to be inclined upward as it goes rearward from the front end portion.

In the slider according to one embodiment of the present invention, the upper surface of the front end portion of the lower blade, on the side at which the cut-out portion is formed, is provided with:

an introduction inside portion formed to be inclined upward as it goes toward the guide post;

an introduction outside portion formed to be inclined upward as it goes toward the outside; and an introduction middle portion formed in a recessed shape between the introduction inside portion and the introduction outside portion.

In the slider according to one embodiment of the present invention, the lower blade is formed such that a thickness of one of left and right parts thereof, on the side at which the cut-out portion of the upper blade is formed, is thinner than a thickness of the other of the left and right parts, on the side at which the cut-out portion of the upper blade is not formed.

A slide fastener according to one embodiment of the present invention includes:

a fastener chain in which a pair of fastener stringers including a pair of respective fastener tapes and respective element rows constituted of a plurality of elements fixed on respective tape side edge portions of the pair of fastener tapes are arranged so that the element rows are arranged to oppose each other; and the slider as described above attached to be slidable along the element rows and configured to engage and disengage the elements.

The slide fastener according to one embodiment of the present invention further includes:

a top stop formed an top end of the tape side edge portion of each of the pair of fastener tapes; and an opener formed on bottom ends of a tape side edge portions of the pair of fastener tapes.

Advantageous Effects of Invention

According to the slider and the slide fastener of one embodiment of the present invention, on the part of the upper blade, which is located on one of left and right sides with the guide post, the cut-out portion is formed to be positioned in the rear of a front end portion of the part of the upper blade, which is located on the other of the left and right sides with the guide post, and also the front end portion of the lower blade. Accordingly, an insertion position of the separable pin can be easily seen and also the lower blade can guide the separable pin and the elements. Therefore, in the slider and the slide fastener of one embodiment of the present invention, a good operability is achieved while having a compact and simple structure and also a separable pin and elements can be simply inserted into the slider.

DESCRIPTION OF EMBODIMENTS

Hereinafter, a slider 40 and a slide fastener 10 according to one embodiment of the present invention will be described in detail with reference to the accompanying drawings.

Figure 1:
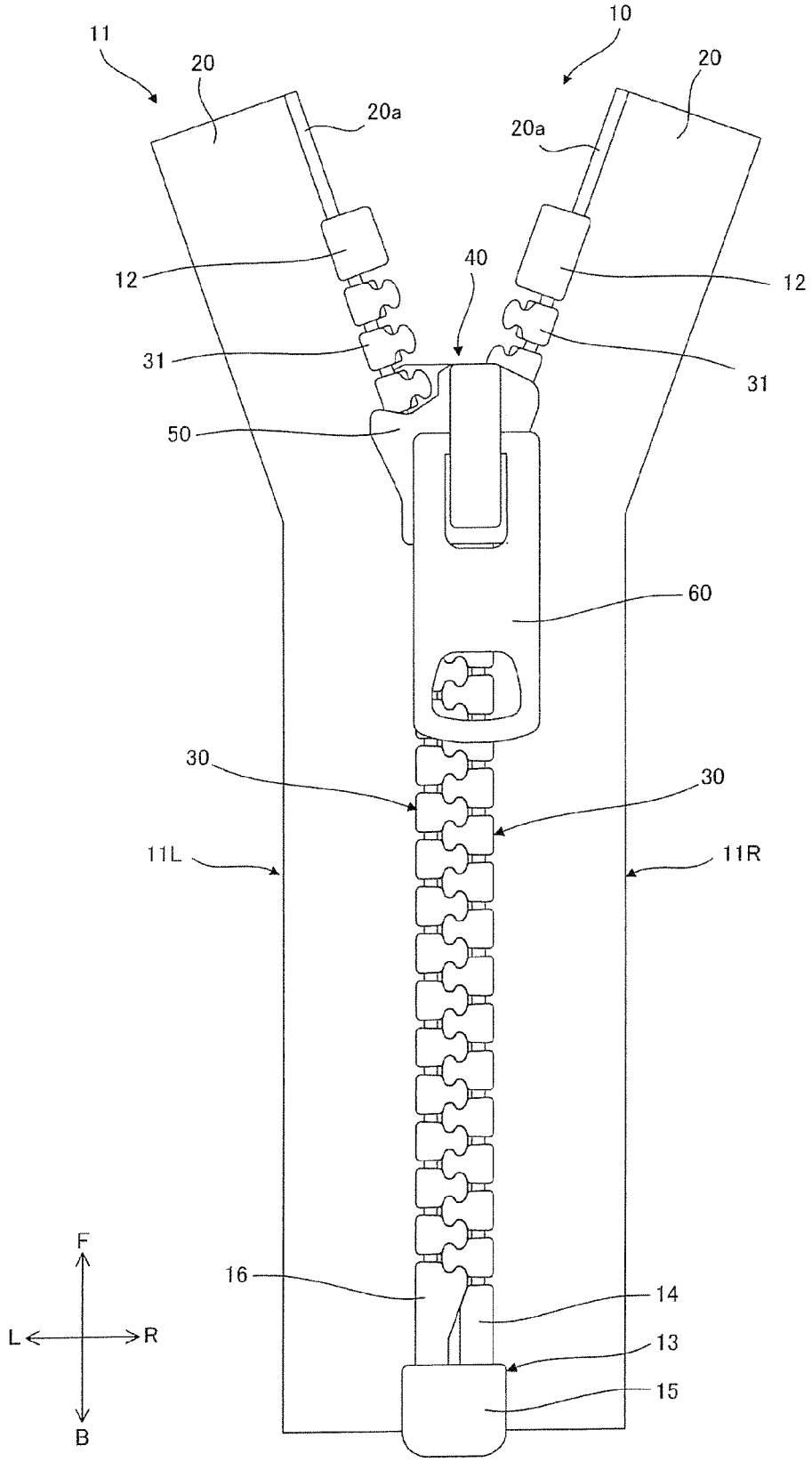
FIG. 1 shows a slide fastener according to the present embodiment.
Figure 2:
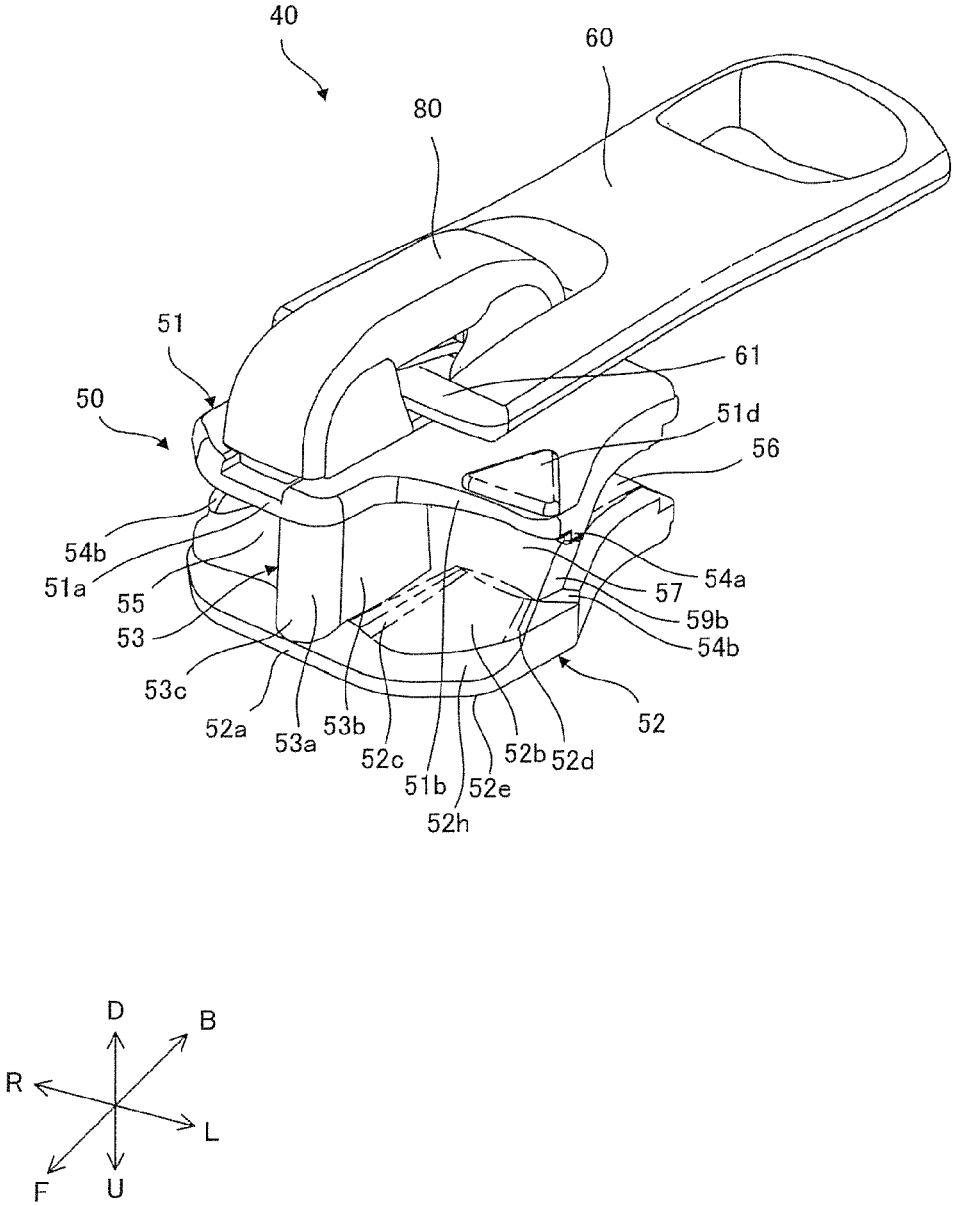
FIG. 2 shows a perspective view of a slider according to the present embodiment.
Figure 3:
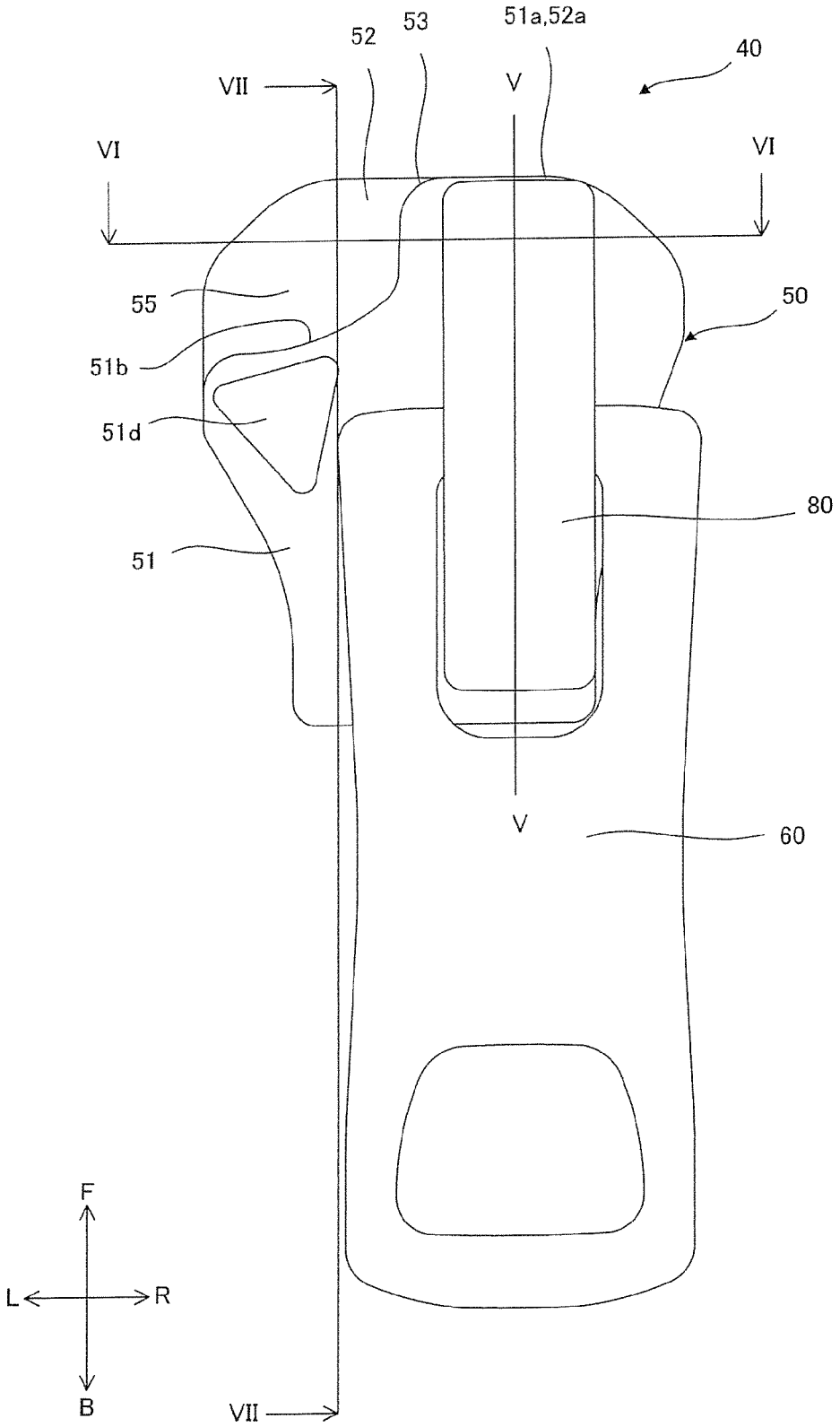
FIG. 3 shows a plan view of a slider according to the present embodiment.
Figure 4:
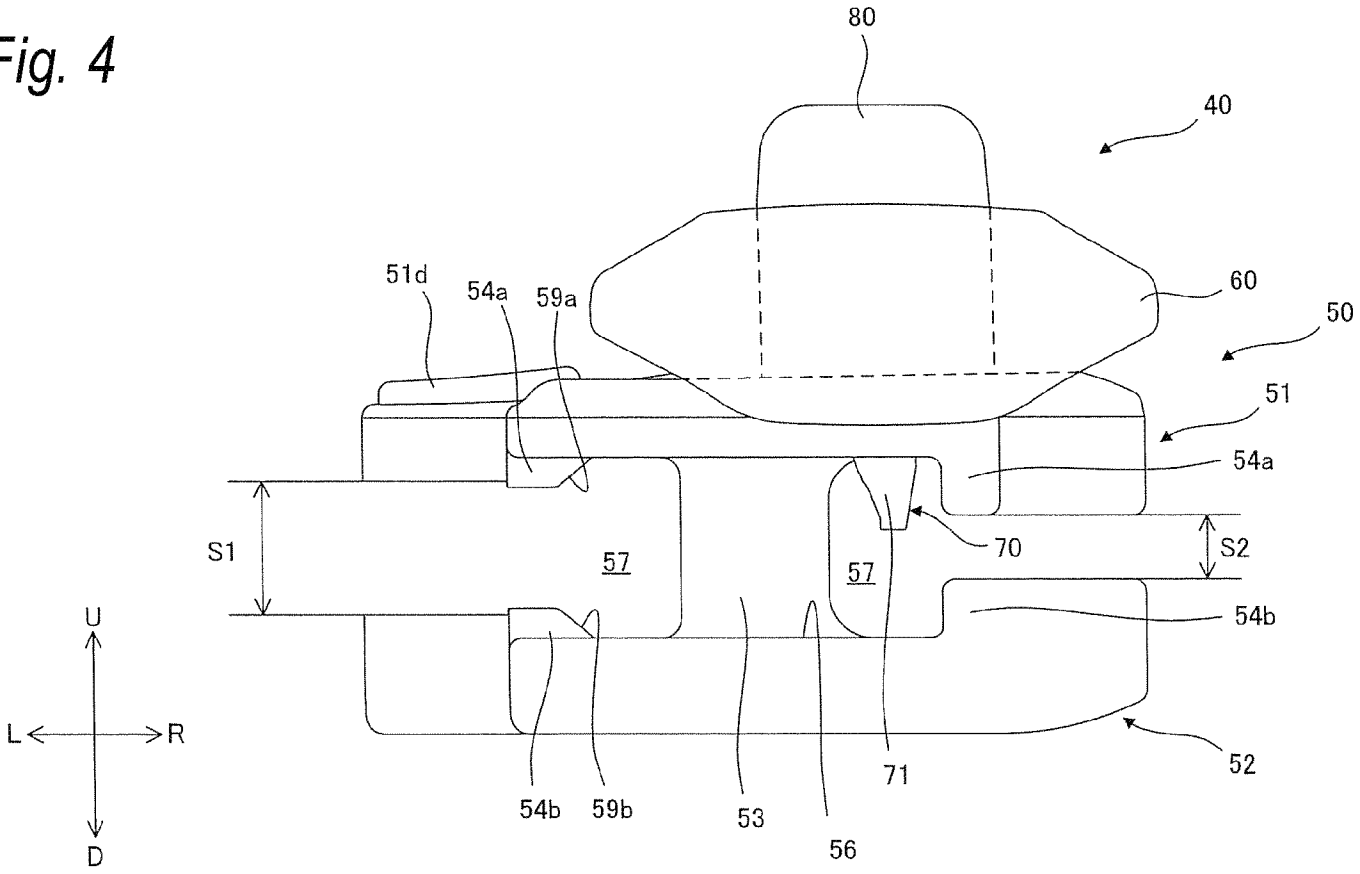
FIG. 4 shows a rear view of the slider according to the present embodiment as viewed from a rear mouth side thereof.
Figure 5:
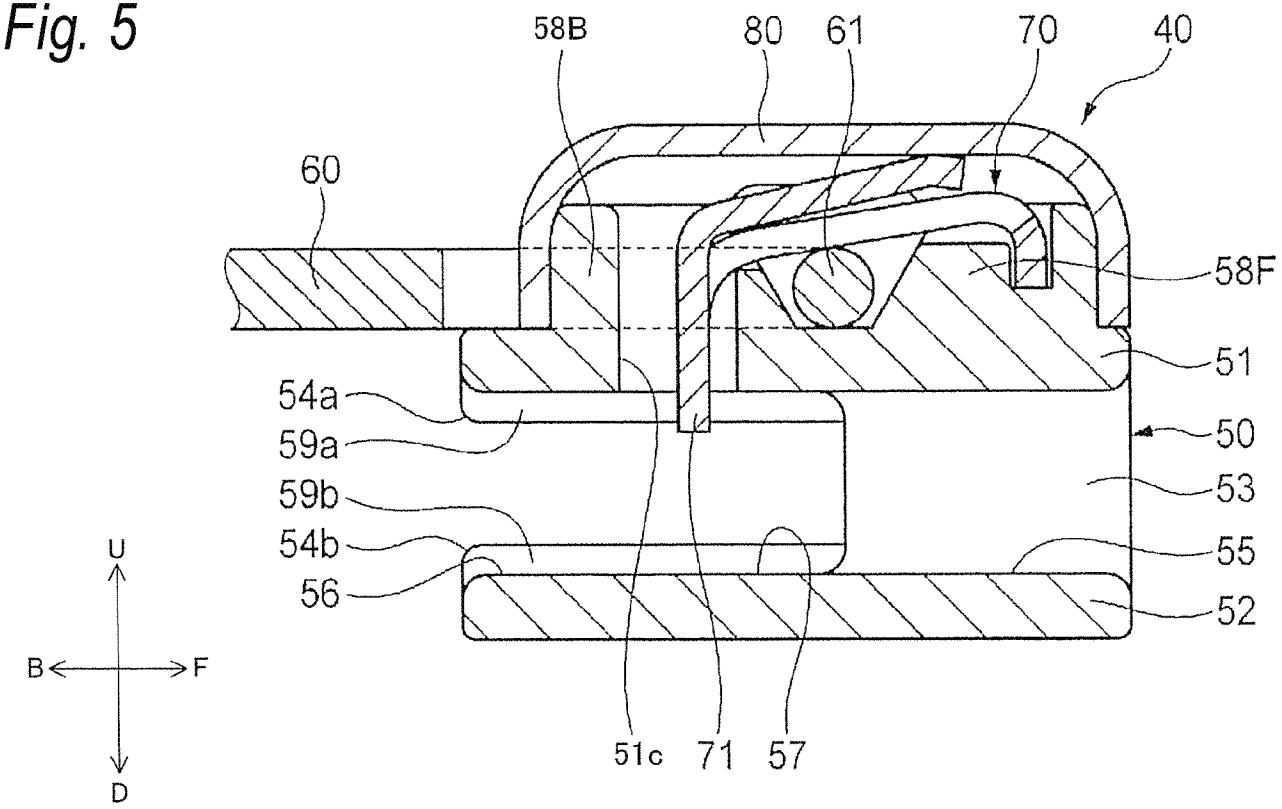
FIG. 5 shows a sectional view taken along a V-V line in FIG. 3.
Figure 6:
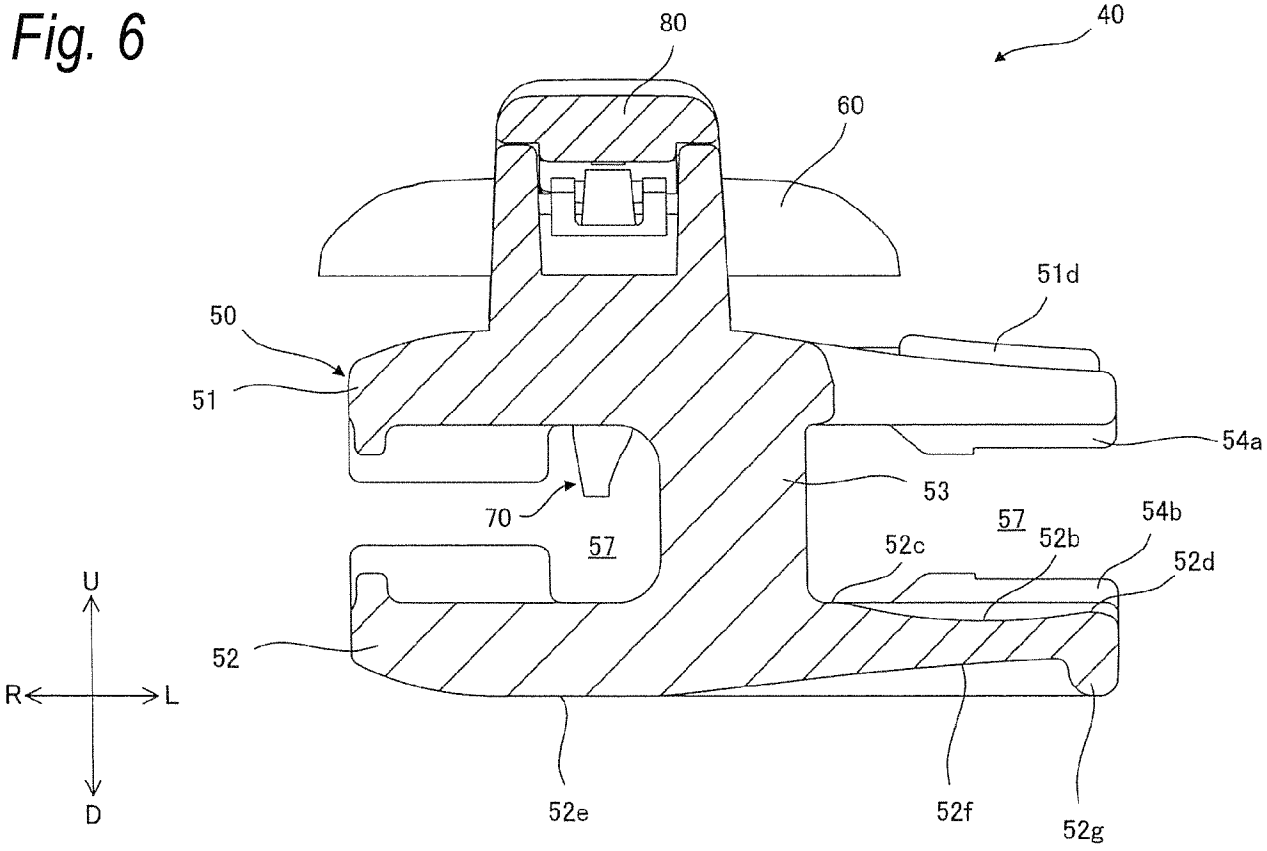
FIG. 6 shows a sectional view taken along a VI-VI line in FIG. 3.
Figure 7:
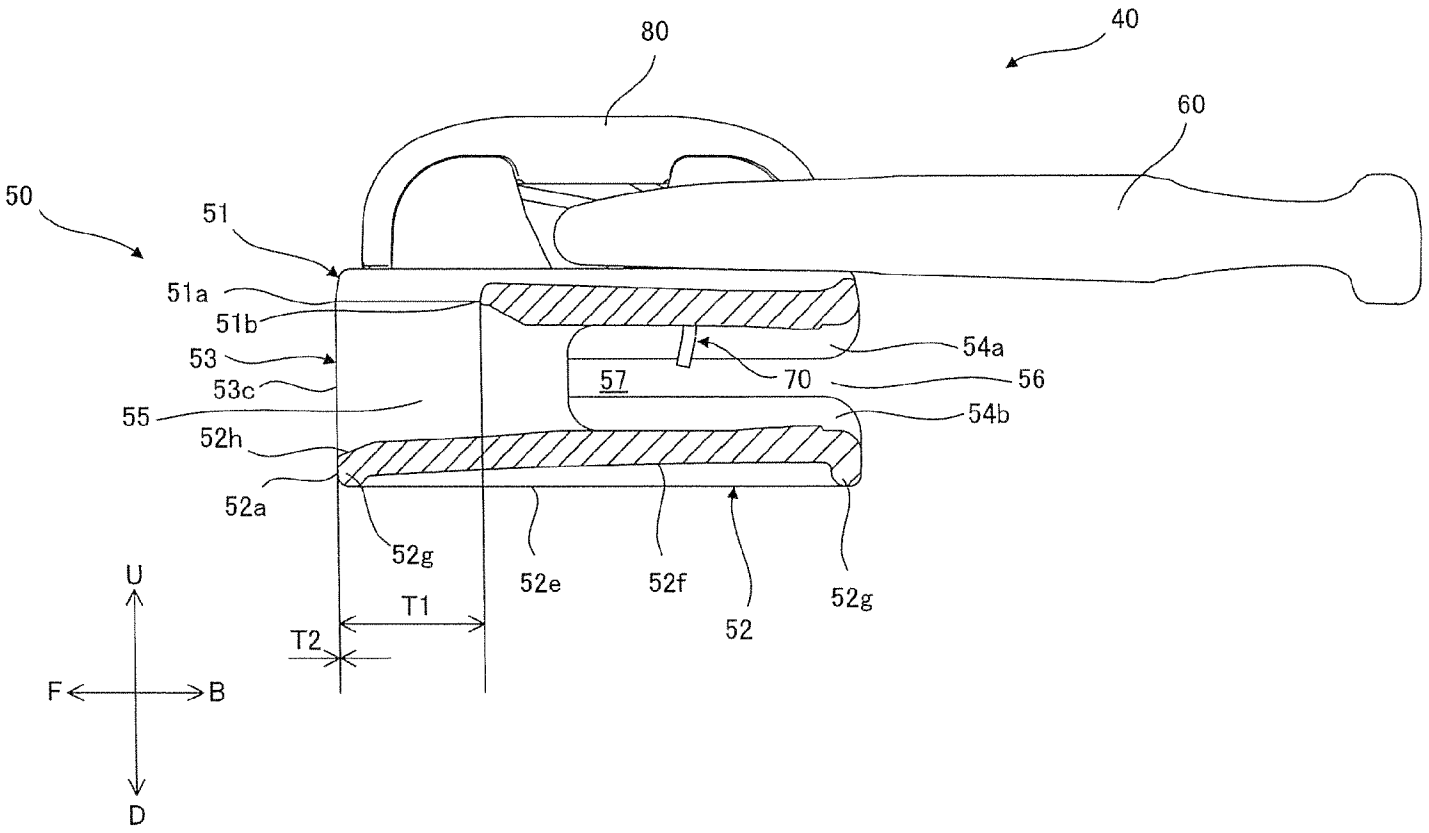
FIG. 7 shows a sectional view taken along a VII-VII line in FIG. 3.
Figure 8:
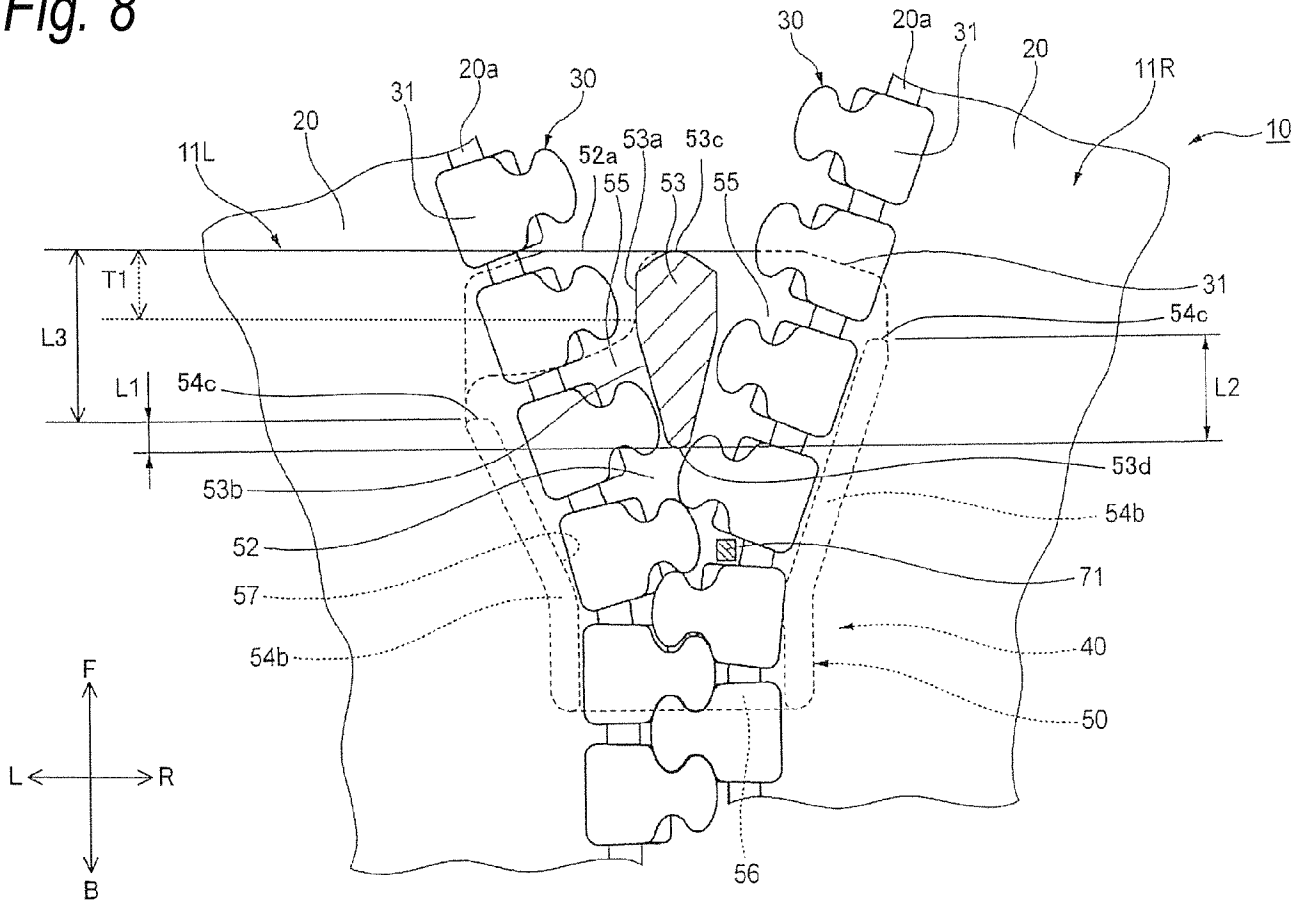
FIG. 8 shows an enlarged front surface view of the slide fastener in a state where an upper blade of the slider according to the present embodiment is partially cut out.
Figure 9:
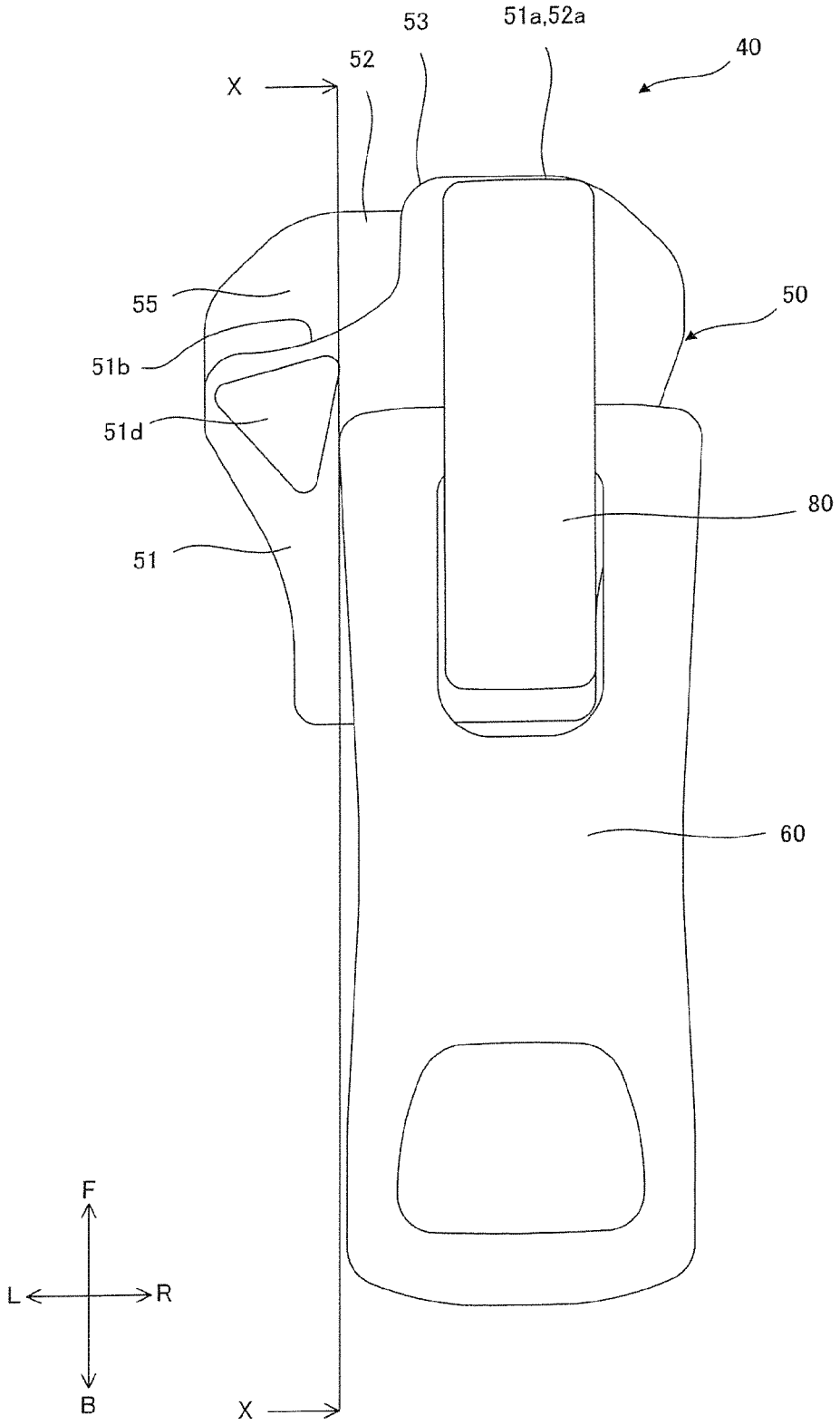
FIG. 9 shows a plan view of a slider according to another embodiment.
Figure 10:
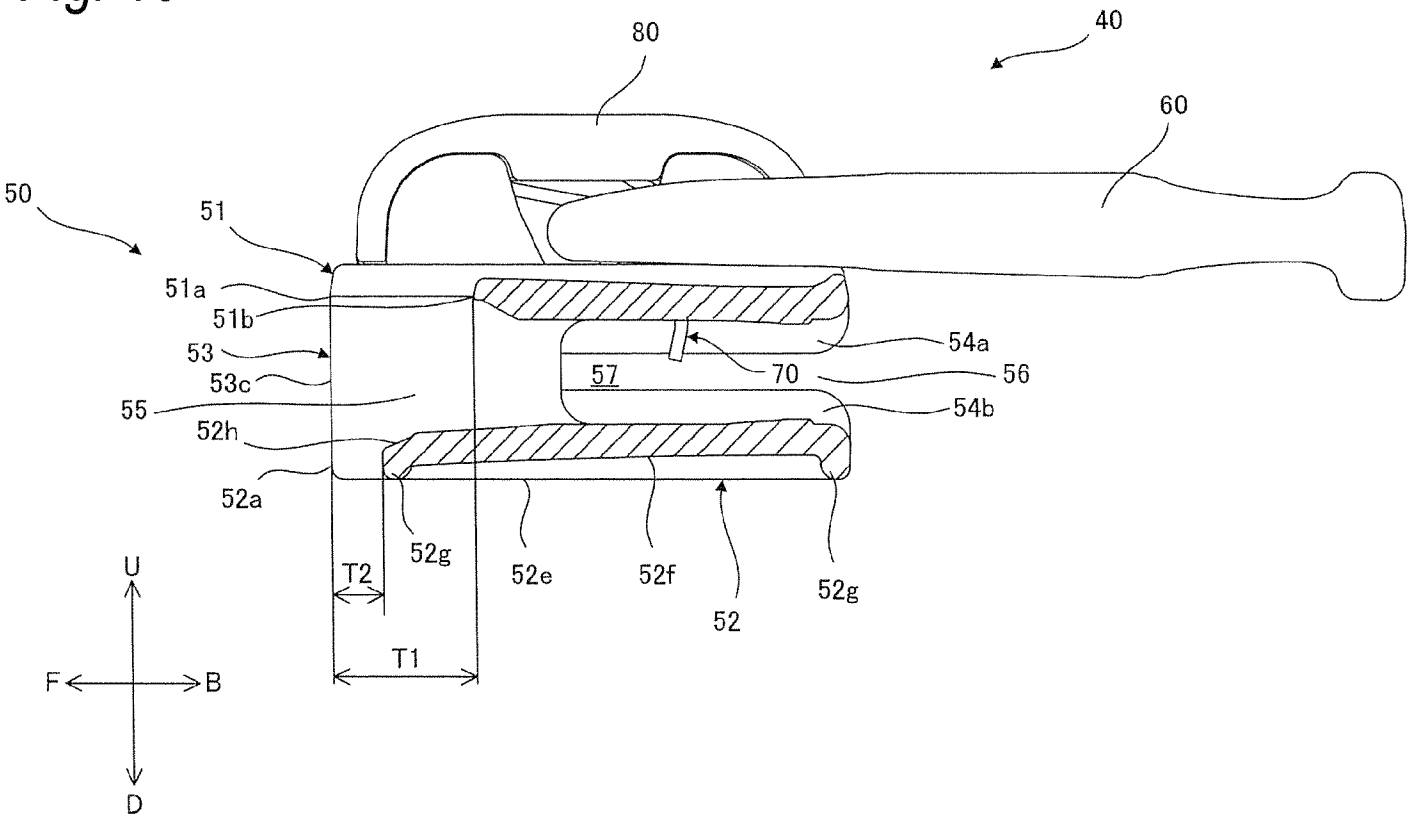
FIG. 10 shows a sectional view taken along an X-X line in FIG. 9.

FIG. 1 shows a slide fastener according to the present embodiment. FIG. 2 shows a perspective view of a slider according to the present embodiment. FIG. 3 shows a plan view of a slider according to the present embodiment. FIG. 4 shows a rear view of the slider according to the present embodiment as viewed from a rear mouth side thereof. FIG. 5 shows a sectional view taken along a V-V line in FIG. 3. FIG. 6 shows a sectional view taken along a VI-VI line in FIG. 3. FIG. 7 shows a sectional view taken along a VII-VII line in FIG. 3. FIG. 8 shows an enlarged surface view of the slide fastener in a state where an upper blade of the slider according to the present embodiment is partially cut out. FIG. 9 shows a plan view of a slider according to another embodiment. FIG. 10 is a sectional view taken along an X-X line in FIG. 9.

Meanwhile, in a slide fastener 10 of the present embodiment, a lengthwise direction of a fastener tape 2 is referred to as a front-rear direction (F-B direction) and is represented by arrows F (forward direction) and R (rearward direction). Also, a widthwise direction of the fastener tape 2 is referred to as a left-right direction (L-R direction) and is represented by arrows L (left direction) and R (right direction). Further, a front and back direction of the fastener tape 2 is referred to as an up-down direction (U-D direction) and is represented by arrows U (upward direction) and D (downward direction). In addition, it should be noted that directions in the slider 40 itself is based on directions in the slide fastener 10 when the slider 40 is attached on the slide fastener 10.

That is, an upper side refers to a front side with respect to the paper surface of FIG. 1; a lower side refers to a back side with respect to the paper surface of FIG. 1; a front side refers to an upper side with respect to the paper surface of FIG. 1; a rear side refers to a lower side with respect to the paper surface of FIG. 1; a left side refers to a left side with respect to the paper surface of FIG. 1; and a right side refers to a right side with respect to the paper surface of FIG. 1.

Further, the left-right direction of the fastener tape 2 is also referred to as the widthwise direction. Also, the up-down direction of the fastener tape 2 is also referred to as the lengthwise direction.

As shown in FIGS. 1 and 8, the slide fastener 10 of the present embodiment includes a fastener chain 11 constituted of a pair of fastener stringers 11L, 11R, which have a pair of respective fastener tapes 20 and respective element rows 30 each constituted of a plurality of elements 31 fixed on respective edge portions 20*a* of the pair of fastener tapes 20 at predetermined pitches, and in which the element rows 30 are arranged to oppose each other; a slider 40 attached to be slidable along the fastener element rows 30 and configured to engage and disengage the fastener elements 31; a top stop 12 formed an top end of a tape side edge portion 20*a* of each of the pair of left and right fastener tapes 20; and an opener 13 formed on bottom ends of a tape side edge portions 20*a* of the pair of left and right fastener tapes 20.

The opener 13 includes a retainer pin 14 and a box body 15 formed on the top end of the tape side edge portion 20*a* of the right fastener tape 20, and a separable pin 16 formed on the bottom end of the tape side edge portion 20*a* of the left fastener tape 20 and capable of be inserted in the box body 15. Further, in the present embodiment, the left fastener stringer 11L provided with the separable pin 16 is a separable fastener stringer which can be separated from the slider 40, and the right fastener stringer 11R provided with the retainer pin 14 and the box body 15 is a fixed fastener stringer, which cannot be separated from the slider 40. Alternatively, the left and right arrangement of the retainer pin 14, and the box body 15 and separable pin 16 may be reversed.

Each of the fastener element rows 30 is constituted of a plurality of fastener elements 31, and the fastener elements 31 are injection-molded on the tape side edge portion 20*a* of the respective fastener tapes 20 using synthetic resin, such as polyamide, polyacetal, polypropylene or polybutylene terephthalate.

As shown in FIGS. 2 to 8, the slider 40 is a slider having an automatic stop function and includes a slider body 50, a pull 60, a stop claw body 70 and a pull holding cover 80.

The slider body 50 includes an upper blade 51 and a lower blade 52 arranged to be spaced from each other in the up-down direction and to be parallel to each other; a guide post 53 connecting front end portions of the upper blade 51 and the lower blade 52 at an introduction middle portion; upper flanges 54*a* protruding downward from left and right side edges of the upper blade 51; and lower flanges 54*b* protruding upward from left and right side edges of the lower blade 52. Accordingly, left and right shoulder mouths 55, which are separated from each other by the guide post 53, are formed in a front portion of the slider body 50, and a rear mouth 56 is formed in a rear portion of the slider body 50. Also, an element guide passage 57 having a generally Y-shape is formed between the upper blade 51 and the lower blade 52 to communicate the left and right shoulder mouths 55 with the rear mouth 56. The element guide passage 57 forms a passage allowing the pair of left and right fastener element rows 30 to be inserted therethrough.

Further, as shown in FIG. 4, a dimension S1, in the up-down direction, of a gap between the left upper and lower flanges 54*a*, 54*b* of the slider body 50 is set to be greater than a dimension S2, in the up-down direction, of a gap between the right upper and lower flanges 54*a*, 54*b*. Thus, when a crosswise force is exerted on the pair of left and right fastener stringers 11L, 11R, the left fastener stringer 11L can be separated from the slider 40.

Further, as shown in FIG. 5, on a part of an upper surface of the upper blade 51, which is located on a right side with respect to the guide post 53 (on the side of the fixed fastener stringer 11R), a front attaching post 58F and a rear attaching post 58B configured to allow a pull holding cover 80 to be attached thereto are erected side by side in the front-rear direction. More specifically, as shown in FIG. 8, the guide post 53 has a left lateral surface (front lateral surface 53*a* and rear lateral surface 53*b*) and a right lateral surface, and the front attaching post 58F and the rear attaching post 58B are erected on the part of the upper surface of the upper blade 51, which is located on the right side with respect to the left lateral surface of the guide post 53. In addition, a link portion 61 of the pull 60 and the stop claw body 70 are received between the front attaching post 58F and the rear attaching post 58B, and the pull holding cover 80 is covered on the front attaching post 58F and the rear attaching post 58B and also fixed thereto by crimping. Further, in the upper blade 51, a claw insertion hole 51*c* is formed to allow a stop claw 71 of the stop claw body 70 to be inserted therein. Meanwhile, in the present embodiment, the front attaching post 58F, the rear attaching post 58B, the stop claw body 70 and the pull holding cover 80 constitute a pull attachment portion.

Also, as described above, since the front attaching post 58F and the rear attaching post 58B are formed on the part of the upper blade 51, which is located on the right side with respect to the guide post 53, a part of the upper blade 51, which is located on the left side with respect to the guide post 53, has a slightly reduced rigidity and thus is configured to be easily bent. Since the left part of the upper blade 51 is bent, the separable fastener stringer 11L can be separated from the slider 40.

Further, in addition to the front attaching post 58F and the rear attaching post 58B, the stop claw body 70 is also arranged on the part of the upper blade 51, which is located on the right side with respect to the guide post 53. Accordingly, as shown in FIG. 8, the stop claw 71 of the stop claw body 70 is inserted between fastener elements 31 of the fixed fastener stringer 11R. Therefore, contact between the stop claw 71 and the fastener elements 31 of the separable fastener stringer 11L is prevented, thereby allowing the separable fastener stringer 11L to be separated from the slider 40.

However, although the slider 40 having an automatic stop function is illustrated in the present embodiment, the present invention is not limited thereto. A slider 40 having an automatic stop function, in which a pull attaching post configured to allow the pull 60 to be attached thereto is erected to replace the front attaching post 58F and the rear attaching post 58B, may be employed.

Further, as shown in FIGS. 2 and 3, the upper blade 51 has a cut-out portion 51*b* formed to extend from the left front lateral surface 53*a* of the guide post 53 toward the outside (toward the separable fastener stringer 11L). Also, the cut-out portion 51*b* is formed to be inclined rearward as it goes from the left front lateral surface 53*a* of the guide post 53 toward the outside. More specifically, as shown in FIG. 8, the guide post 53 has a front end portion 53*c*, a rear end portion 53*d*, the left lateral surface (front lateral surface 53*a* and rear lateral surface 53*b*) and the right lateral surface, and the cut-out portion 51*b* is formed to extend between the front end portion 53*c* and the rear end portion 53*d* of the guide post 53 and also from the left lateral surface of the guide post 53 outwardly. Thus, as shown in FIGS. 7 and 10, the cut-out portion 51*b* of the upper blade 51 on the left side of the guide post 53 is positioned in the rear of the front end portion 52*a* of the lower blade 52. Also, the cut-out portion 51*b* of the upper blade 51 on the left side of the guide post 53 is positioned in the rear of a front end portion 51*a* of the part of the upper blade 51, which is located on the right side with respect to the guide post 53. Further, a distance T1 from the front end portion 53*c* of the guide post 53 to the cut-out portion 51*b* of the upper blade 51 is longer than a distance T2 from the front end portion 53*c* of the guide post 53 to the front end portion 52*a* of the lower blade 52. Meanwhile, in the slider 40 of the present embodiment, the distance T1 from the front end portion 53*c* of the guide post 53 to the cut-out portion 51*b* of the upper blade 51 is about ¼ to ⅓ of a distance from the front end portion 53*c* of the guide post 53 to the rear end of the slider 40.

Due to this configuration, according to the slider 40 and the slide fastener 10 of the present embodiment, parts of the upper blade and the lower blade, which are located on one side in the widthwise direction with respect to the guide post, can be easily bent and also an insertion position of the separable pin can be easily seen. Further, since the cut-out portion 51*b* is formed on a front end portion of a part of the upper blade 51, which is located on one of left and right sides with respect to the guide post 53, a region, on which the front attaching post 58F and the rear attaching post 58B can be erected, can be set aside on a part of the upper blade 51, which is located on the other of the left and right sides with respect to the guide post 53. Further, when a crosswise force is exerted on the pair of left and right fastener stringers 11L, 11R, the part of the upper blade 51, which is located on the one of the left and right sides with respect to the guide post 53 and on which the cut-out portion 51*b* is formed, is more easily bent than the part of the upper blade 51, which is located on the other of the left and right sides with respect to the guide post 53 and on which the cut-out portion 51*b* is not formed. Therefore, it is possible to achieve a good operability while having a compact and simple structure. Also, when a crosswise force is exerted on the pair of left and right fastener stringers 11L, 11R, one fastener stringer 11L can be easily separated from the slider 40. In addition, the separable pin 16 and the elements 31 can be simply inserted into the slider 40.

On the other hand, a left part of the front end portion 52*a* of the lower blade 52 is formed to be flush with a right part of the front end portion 52*a* of the lower blade 52 as shown in FIG. 3, or is formed in the rear of the front end portion 53*c* of the guide post 53 in order to satisfy T1>T2 as shown in FIG. 9.

Due to this configuration, according to the slider 40 and the slide fastener 10 of the present embodiment, the insertion position of the separable pin 16 can be more easily seen. Thus, the separable pin 16 and the elements 31 can be more simply inserted into the slider 40.

Further, the left part of the front end portion 52*a* of the lower blade 52 may be positioned at the same or substantially the same position as that of the front end portion 53*c* of the guide post 53 in the front-rear direction (F-B direction). That is, the distance T2 from the front end portion 53*c* of the guide post 53 to the front end portion 52*a* of the lower blade 52 may be zero. Further, the front end portion 52*a* of the lower blade 52 may be positioned at the same or substantially the same position as that of the front end portion 51*a* of the right part of the upper blade 51 in the front-rear direction (F-B direction).

Due to this configuration, according to the slider 40 and the slide fastener 10 of the present embodiment, it is possible to achieve a good operability while having a more compact and simple structure.

Also, as shown in FIG. 8, a distance L1 between the rear end portion 53*d* of the guide post 53 and a front end portion 54*c* of the left upper and lower flanges 54*a*, 54*b* of the slider body 50 in the front-rear direction is shorter than a distance L2 between the rear end portion 53*d* of the guide post 53 and the front end portion 54*c* of the right upper and lower flanges 54*a*, 54*b* of the slider body 50 in the front-rear direction. Further, a distance L3 between the front end portion 53*c* of the guide post 53 and the front end portion 54*c* of the left upper and lower flanges 54*a*, 54*b* in the front-rear direction is longer than the distance T1 from the front end portion 53*c* of the guide post 53 to the cut-out portion 51*b* of the upper blade 51.

Also, as shown in FIGS. 2 and 4, the cut-out portion 51*b* is formed to extend from generally the middle of the left rear lateral surface 53*b* of the guide post 53 outwardly in the widthwise direction. Further, inside surfaces, in the widthwise direction, of the left upper and lower flanges 54*a*, 54*b* of the slider body 50 are respectively formed by inclined surfaces 59*a*, 59*b*, of which thickness is gradually increased toward the outside.

As shown in FIG. 3, an insertion direction indicator portion 51*d* is formed on an upper surface of the left part of the upper blade 51. By forming the insertion direction indicator portion 51*d*, a direction of the separable pin 16 when being inserted into the slider 40 can be easily identified. In the present embodiment, the insertion direction guide portion 51*d* is formed to protrude from the upper surface. Since the insertion direction indicator portion 51*d* is formed to protrude from the upper surface, it is possible to prevent adhesion with another slider 40 upon manufacturing. Also, the insertion direction indicator portion 51*d* of the present embodiment is formed in a triangular shape so that an apex thereof is oriented toward the rear mouth, thereby indicating the insertion direction of the separable pin 16. Alternatively, any other shapes, such as a rounded shape or a quadrangular shape, may be employed.

Further, as shown in FIG. 6, the lower blade 52 has an introduction middle portion 52*b* formed on a part thereof, which defines the shoulder mouths 55, to have a recessed shape between an introduction inside portion 52*c* and an introduction outside portion 52*d*. That is, since the introduction inside portion 52*c* is formed to be inclined upward as it goes from the introduction middle portion 52*b* toward the guide post 53 and the introduction outside portion 52*d* is formed to be inclined upward as it goes from the introduction middle portion 52*b* toward the outside, the introduction middle portion 52*b* is formed at a location below the introduction inside portion 52*c* and the introduction outside portion 52*d* on both sides thereof. In addition, as shown in FIG. 7, on a part ranging from the front end portion 52*a* to the introduction middle portion 52*b*, introduction inside portion 52*c* and introduction outside portion 52*d*, an inclined portion 52*h* is formed to be gradually inclined upward toward the rear side. Also, a part of the lower blade 52, which is located on a left side with respect to the guide post 53, is formed such that a thickness of a front side thereof is thinner than a thickness of a rear side thereof and also a front end thereof is thinnest.

Therefore, according to the slider 40 of the present embodiment, it is possible to guide the separable pin 16 and the elements 31 to the element guide passage 57, thereby allowing the separable pin 16 and the elements 31 to be more simply inserted therein.

Also, as shown in FIGS. 6 and 7, the lower blade 52 is formed such that a thickness of one of left and right parts thereof, on the side of which the cut-out portion 51*b* of the upper blade 51 is formed, is thinner than a thickness of the other of the left and right parts, on the side of which the cut-out portion 51*b* of the upper blade 51 is not formed. Further, protrusions 52*g* are formed to protrude downward from top and bottom end portions and a left end portion of a lower surface 52 of the lower blade 52. As a result, a recess portion 52*f* is formed on the lower surface 52*e* of one of the left and right parts of the lower blade 52, on the side of which the cut-out portion 51*b* of the upper blade 51 is formed.

Also, according to the slider 40 of the present embodiment, a part of the lower blade 52, which is located on one side in the widthwise direction with respect to the guide post 53, can be configured to be more easily bent, since a thickness of one of the left and right parts of the lower blade 52, on the side of which the cut-out portion 51*b* of the upper blade 51 is formed, is thinner than a thickness of the other of the left and right parts, on the side of which the cut-out portion 51*b* of the upper blade 51 is not formed. Therefore, it is possible to separate one fastener stringer 11L from the slider 40.

Further, according to the slider 40 of the present embodiment, it is possible to prevent adhesion with another slider 40 upon manufacturing thereof, since the protrusions 52*g* are formed. In addition, by forming the protrusions 52*g* to have a rounded surface, an edge is not formed on the end portions, thereby preventing contact with the edge.

Next, an operation of the slide fastener 10 using the slider 40 of the present embodiment as described above will be described.

In the following, a state where the separable pin 16 is being inserted into the slider 40 will be described.

Figure 11:
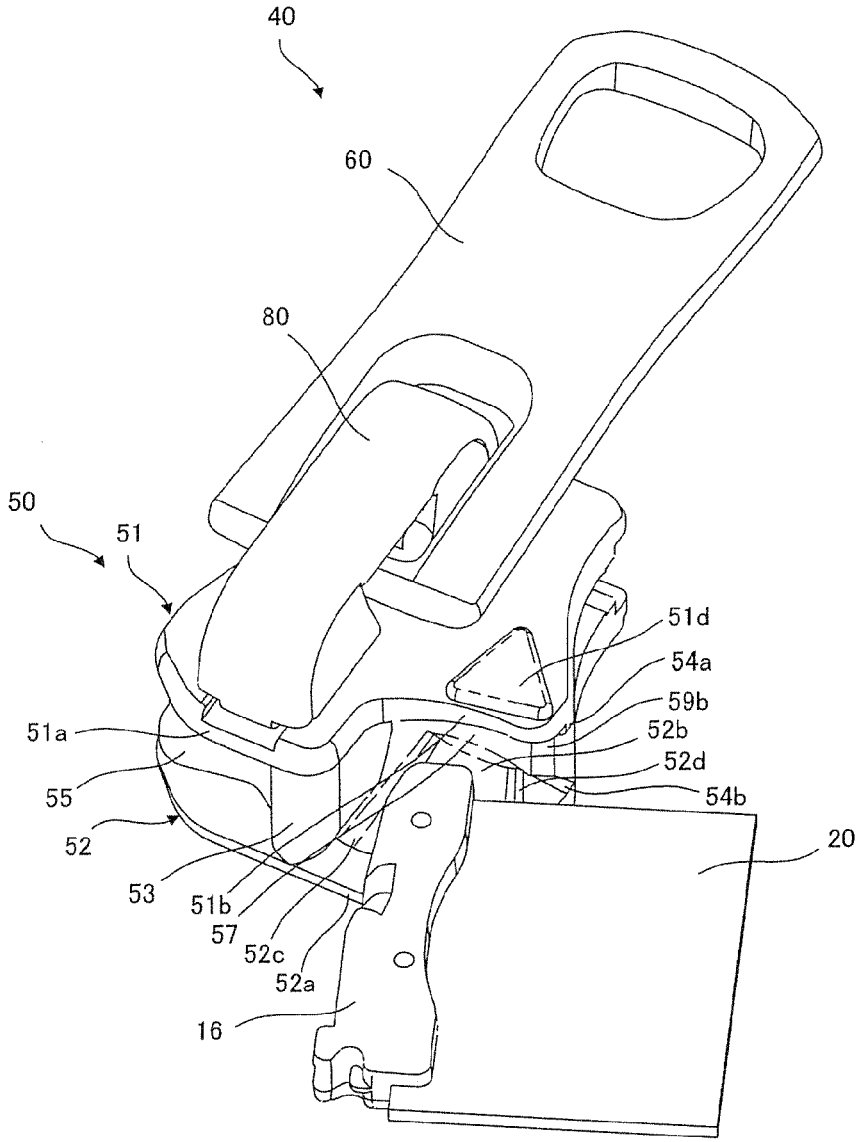
FIG. 11 shows a state where a separable pin is being inserted into the slider according to the present embodiment.

FIG. 11 shows a state where the separable pin 16 is being inserted into the slider 40 according to the present embodiment.

In the slide fastener 10 of the present embodiment, the separable pin 16 is inserted into the element guide passage 57 while being guided by the lower blade 52, when the separable pin 16 is inserted into the slider 40. At this time, if the separable pin 16 abuts against the lower blade 52 of the slider 40, the separable pin 16 is smoothly inserted into the element guide passage 57.

Since the cut-out portion 51*b* is formed on the upper blade 51 of the slider 40, the shoulder mouth 55 allowing the separable pin 16 to be inserted into the element guide passage 57 is widened as compared with a case where the cut-out portion 51*b* is not formed. In the case where the cut-out portion 51*b* is not formed, it is necessary to accurately insert the separable pin 16 into the shoulder mouth 55 from the front side thereof toward the rear side. In the case where the cut-out portion 51*b* is formed, it is possible to insert the separable pin 16 into the shoulder mouth 55 simply by operating the separable pin 16 to be placed on the lower blade 52 from upper and left sides thereof as well as the front side. Also, since the cut-out portion 51*b* is formed to be inclined rearward as it goes from the left front lateral surface 53*a* of the guide post 53 toward the outside, it is possible to form the shoulder mouth 55 as wide as possible while maintaining strength of the cut-out portion 51*b*. Further, since the cut-out portion 51*b* is formed in the rear of the front end of the front attaching post 58F, it is possible to add an insertion assist function to the slider without increasing a size of the slider, but while maintaining a function thereof as a slider. That is, the separable pin 16 is guided by the lower blade 52 and thus is smoothly inserted into the element guide passage 57.

Also, the lower blade 52 is formed such that the introduction middle portion 52*b* on the part thereof, which defines the shoulder mouths 55, is formed to have a recessed shape between the introduction inside portion 52*c* and the introduction outside portion 52*d*. Accordingly, the separable pin 16 can naturally approach the introduction middle portion 52*b*, so that the separable pin 16 is more smoothly inserted into the element guide passage 57.

Further, as shown in FIGS. 2 and 4, introduction inside portions on the left upper and lower flanges 54*a*, 54*b* of the slider body 50 are respectively formed by the inclined surfaces 59*a*, 59*b*, of which thickness is gradually increased from the introduction inside portions toward the outside. Accordingly, the separable pin 16 can be guided to the inside, so that the separable pin 16 is more smoothly inserted into the element guide passage 57.

Further, the front attaching post 58F, the rear attaching post 58B and the stop claw body 70 as shown in FIG. 5 are arranged on the part of the upper blade 51, which is located on the right side with respect to the guide post 53. Accordingly, the shoulder mouth 55 allowing the separable pin 16 to be inserted into the element guide passage 57 is widened. That is, the separable pin 16 is guided by the lower blade 52 and thus is smoothly inserted into the element guide passage 57. In addition, visibility of the insertion direction indicator portion 51*d* formed on the upper surface of the left part of the upper blade 51 can be improved.

Subsequently, a state where an element 31 is being inserted into the slider 40 will be described.

Figure 12:
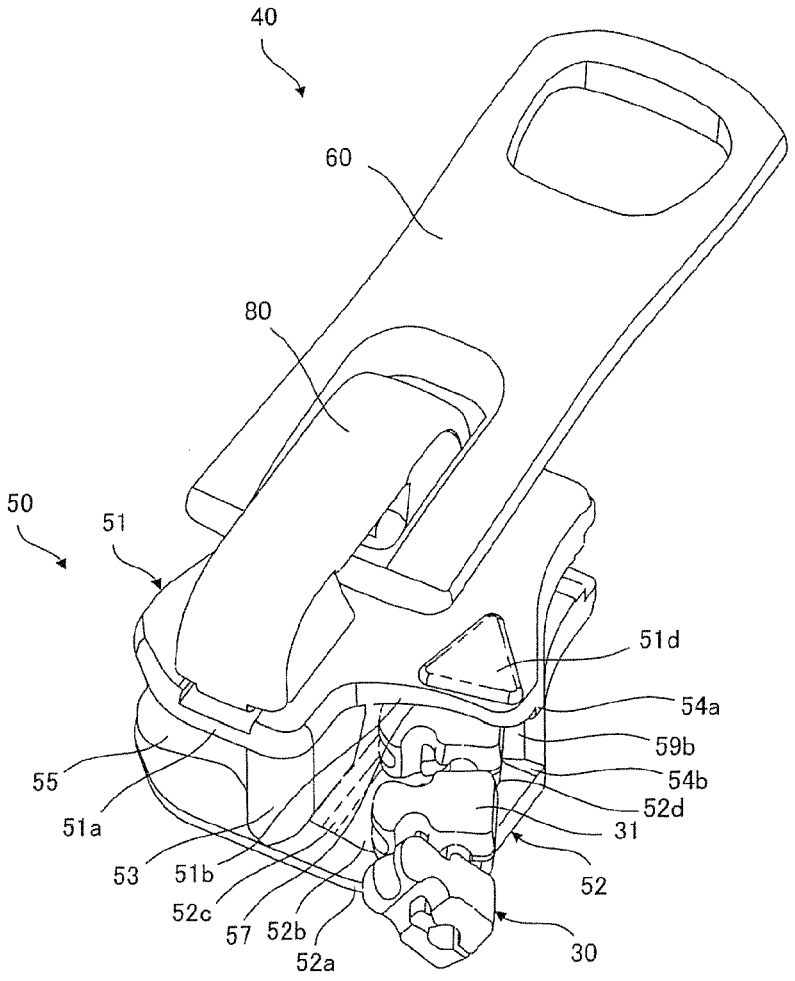
FIG. 12 shows a state where an element is being inserted into the slider according to the present embodiment.

FIG. 12 shows a state where an element 31 is being inserted into the slider 40 according to the present embodiment.

In the slide fastener 10 of the present embodiment, the element 31 is inserted into the element guide passage 57 while being guided by the lower blade 52, when the element 31 is inserted into the slider 40. At this time, if the element 31 abuts against the lower blade 52 of the slider 40, the element 31 is turned in a direction allowing the element 31 to be naturally inserted into the element guide passage 57, so that the element 31 is smoothly inserted into the element guide passage 57.

Since the cut-out portion 51*b* is formed on the upper blade 51 of the slider 40, the shoulder mouth 55 allowing the element 31 to be inserted into the element guide passage 57 is widened as compared with the case where the cut-out portion 51*b* is not formed. That is, the element 31 is guided by the lower blade 52 and thus is smoothly inserted into the element guide passage 57.

Also, the lower blade 52 is formed such that the introduction middle portion 52*b* on the part thereof, which defines the shoulder mouths 55, is formed to have a recessed shape between the introduction inside portion 52*c* and the introduction outside portion 52*d*. Accordingly, the element 31 can naturally approach the introduction middle portion 52*b*, so that the element 31 is more smoothly inserted into the element guide passage 57.

Further, as shown in FIGS. 2 and 4, the introduction inside portions on the left upper and lower flanges 54*a*, 54*b* of the slider body 50 are respectively formed by the inclined surfaces 59*a*, 59*b*, of which thickness is gradually increased from the introduction inside portions toward the outside. Accordingly, the element 31 can be guided to the inside, so that the element 31 is more smoothly inserted into the element guide passage 57.

Further, the front attaching post 58F, the rear attaching post 58B and the stop claw body 70 as shown in FIG. 5 are arranged on the part of the upper blade 51, which is located on the right side with respect to the guide post 53. Accordingly, the shoulder mouth 55 allowing the element 31 to be inserted into the element guide passage 57 is widened. That is, the element 31 is guided by the lower blade 52 and thus is easily inserted into the element guide passage 57. In addition, visibility of the insertion direction indicator portion 51*d* formed on the upper surface of the left part of the upper blade 51 can be improved.

Subsequently, a state where the separable fastener stringer 11L is being separated from the slider 40 will be described.

Figure 13:
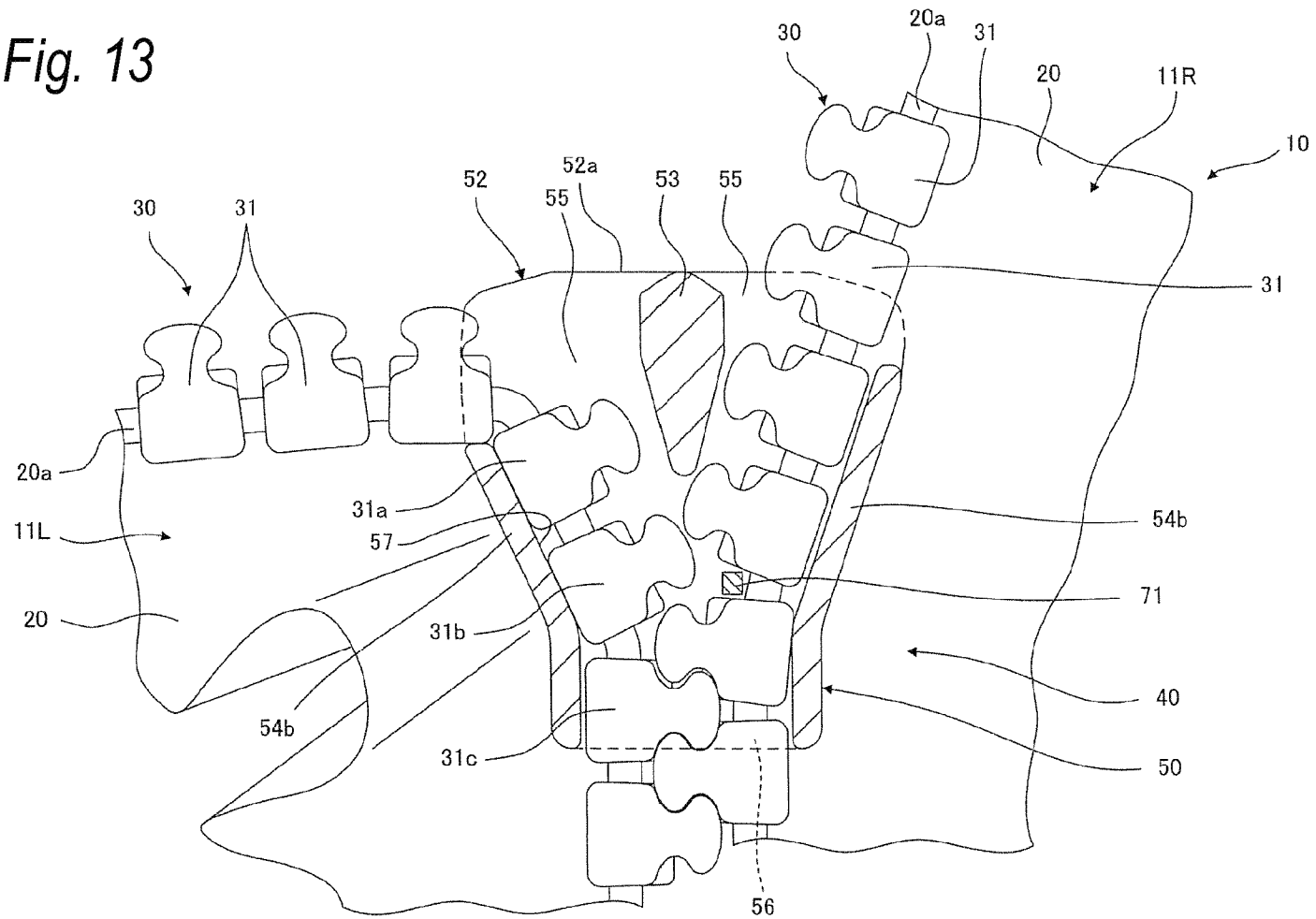
FIG. 13 shows an enlarged front surface view explaining a state where a crosswise force is exerted on the slide fastener shown in FIG. 8.
Figure 14:
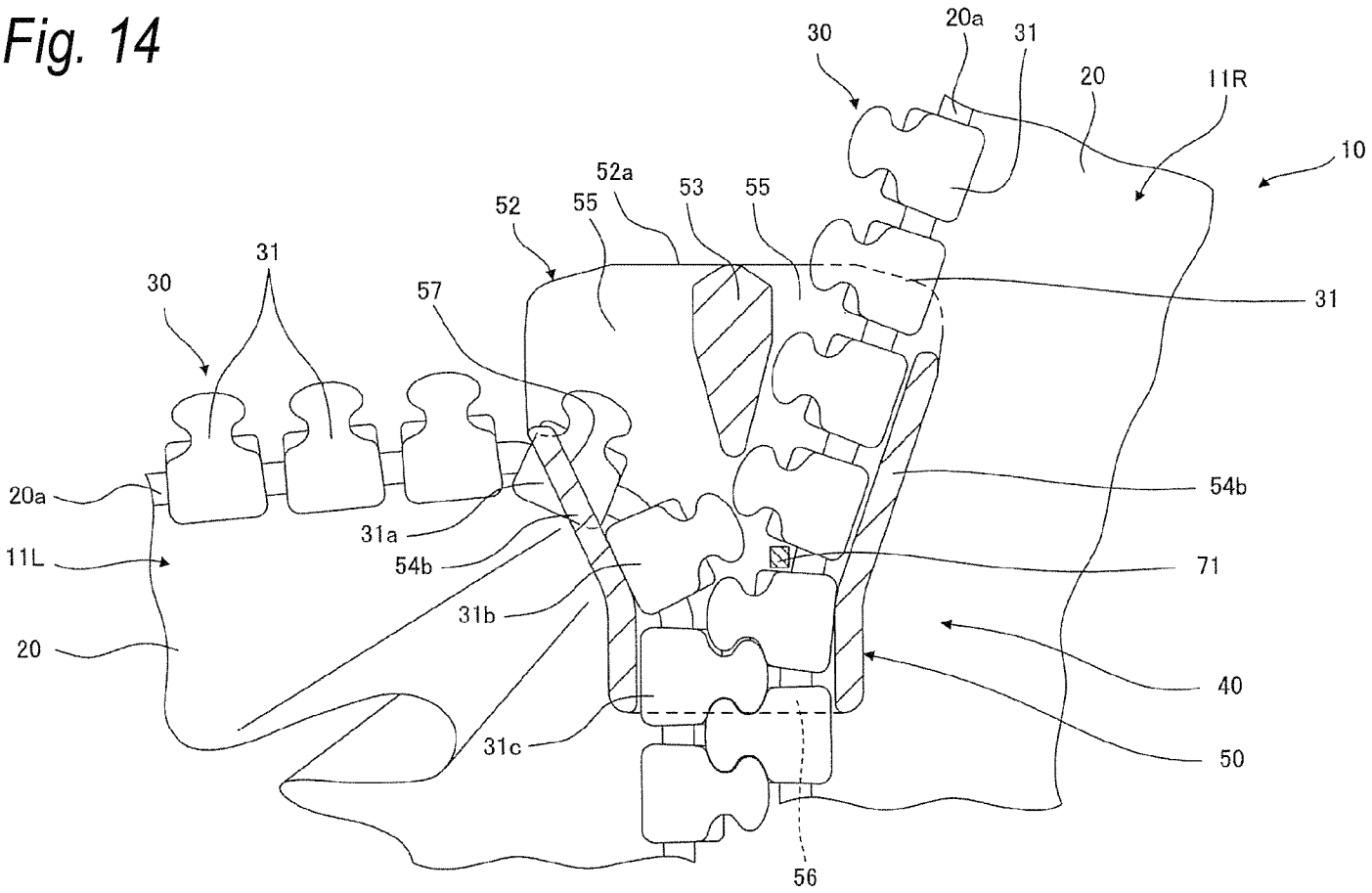
FIG. 14 shows an enlarged front surface view explaining a state where an element of a separable fastener stringer shown in FIG. 13 begins being removed out of the slider.
Figure 15:
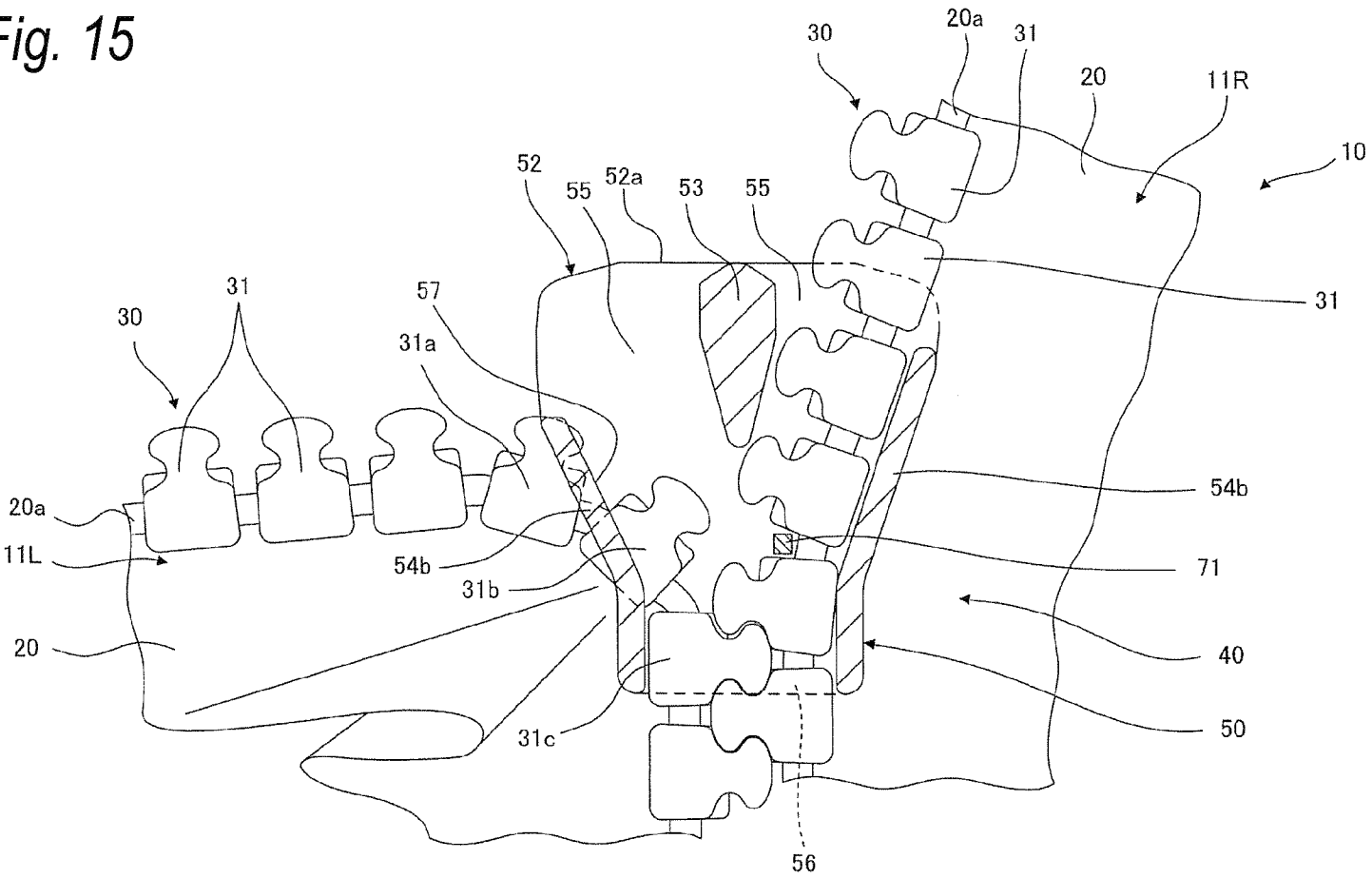
FIG. 15 shows an enlarged front surface view explaining a state where the element shown in FIG. 14 is further removed out of the slider.
Figure 16:
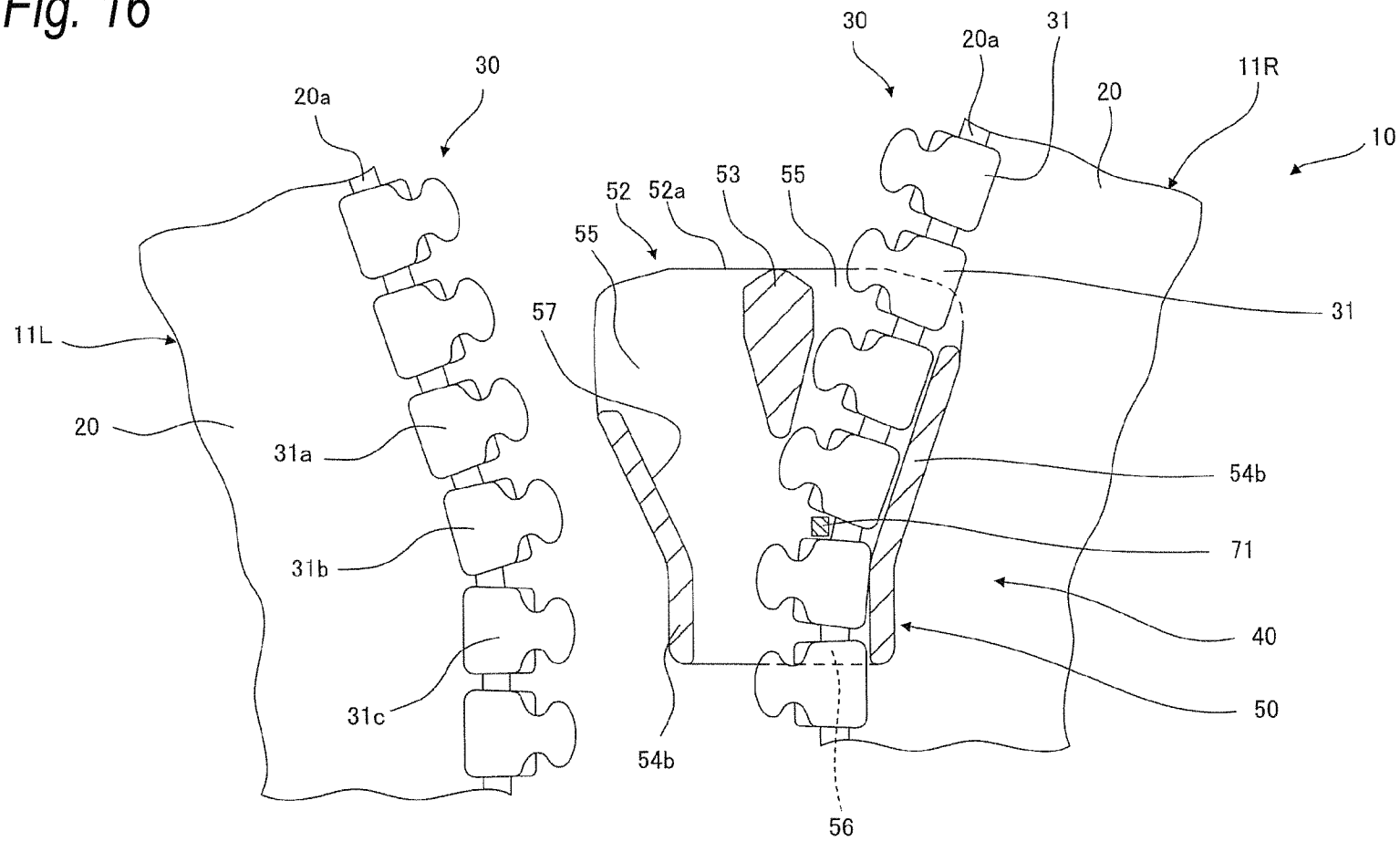
FIG. 16 shows an enlarged front surface view explaining a state where the element shown in FIG. 15 is completely removed out of the slider.
Figure 17:
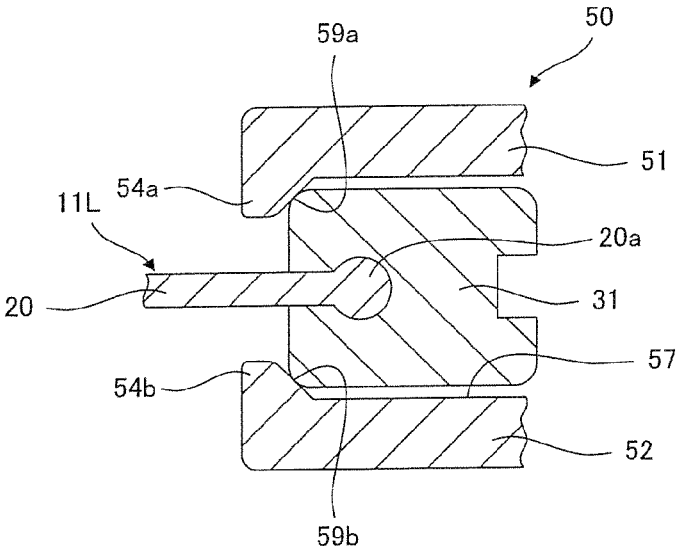
FIG. 17 shows a partial sectional view explaining a state where the element of the separable fastener stringer is in contact with flanges of the slider.
Figure 18:
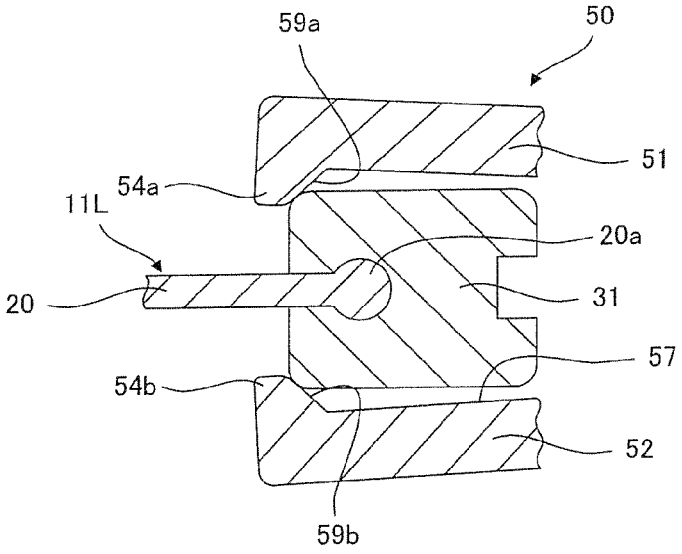
FIG. 18 shows a partial sectional view explaining a state where the element of the separable fastener stringer is pushing and spreading out flanges of the slider.
Figure 19:
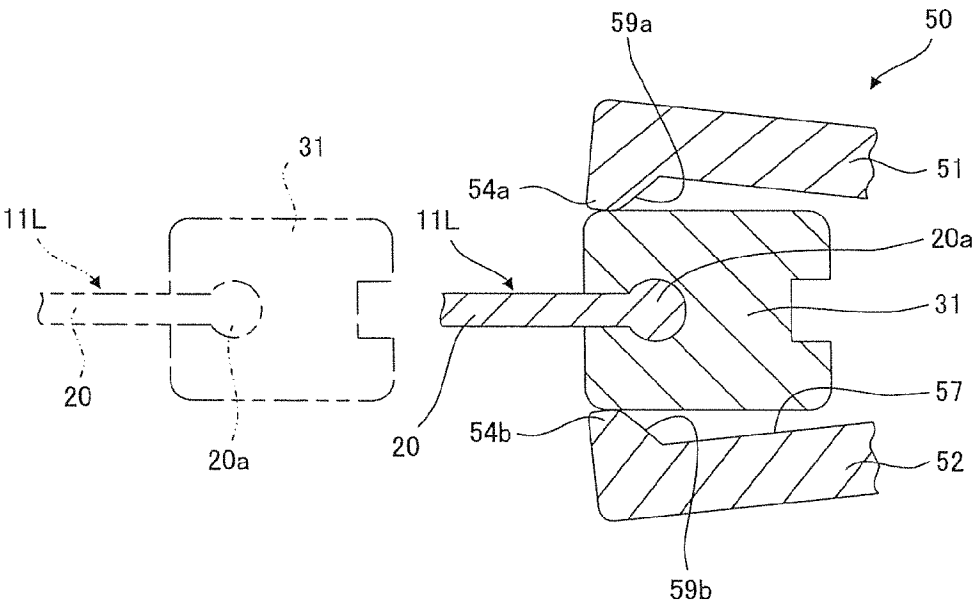
FIG. 19 shows a partial sectional view explaining a state where the element shown in FIG. 14 forces the upper blade and the lower blade to be bent and thus is being removed out of the slider.

FIG. 13 shows an enlarged front surface view explaining a state where a crosswise force is exerted on the slide fastener 10 shown in FIG. 8. FIG. 14 shows an enlarged front surface view explaining a state where an element 31 of the separable fastener stringer 11L shown in FIG. 13 begins being removed out of the slider 40. FIG. 15 shows an enlarged front surface view explaining a state where the element 31 shown in FIG. 14 is further removed out of the slider 40. FIG. 16 shows an enlarged front surface view explaining a state where the element 31 shown in FIG. 15 is completely removed out of the slider 40. FIG. 17 shows a partial sectional view explaining a state where the element 31 of the separable fastener stringer 11L is in contact with the flanges 54*a*, 54*b* of the slide 40. FIG. 18 shows a partial sectional view explaining a state where the element 31 of the separable fastener stringer 11L is pushing and spreading out the flanges 54*a*, 54*b* of the slide 40. FIG. 19 is a partial sectional view explaining a state where the element 31 shown in FIG. 14 forces the upper blade 51 and the lower blade 52 to be bent and thus is being removed out of the slider 40.

If a crosswise force is exerted on the slide fastener 10 shown in FIG. 8, elements 31 of the left element group 30, which do not abut against the upper and lower flanges 54*a*, 54*b*, are pulled out in the left direction as shown in FIG. 13. Meanwhile, as shown in FIGS. 2 and 4, the introduction inside portions on the left upper and lower flanges 54*a*, 54*b* of the slider body 50 are respectively formed by the inclined surfaces 59*a*, 59*b*, of which thickness is gradually increased from the introduction inside portions toward the outside. Accordingly, as shown in FIG. 17, upper and lower corner portions of a fastener element 31 of the separable fastener stringer 11L, on which the crosswise force is exerted, abut respectively against the inclined surfaces 59*a*, 59*b* of the upper and lower flanges 54*a*, 54*b*. Then, the crosswise force is effectively transferred to the upper blade 51 and the lower blade 52 via the inclined surfaces 59*a*, 59*b*.

Therefore, as shown in FIG. 18, a gap between the upper and lower flanges 54*a*, 54*b* in the slide fastener 10 is spread out. Then, a crosswise force toward the introduction outside portion is further exerted on the pair of left and right fastener stringer 11L, 11R. Accordingly, as shown in FIGS. 14 and 19, a first fastener element 31*a* (fastener element 31) of the separable fastener stringer 11L, which is positioned within the element guide passage 57 to be closest to the shoulder mouth 55 and is not engaged, is removed out of the slider 40 by forcing the parts of the upper and lower blades 51, 52, which are located on the left side with respect to the guide post 53, to be bent.

Then, as shown in FIG. 15, subsequently to the first fastener element 31*a*, second and third fastener elements 31*b*, 31*c* are also sequentially removed out of the slider 40 in the same manner as that in the first fastener element 31*a*. Therefore, as shown in FIG. 16, the separable fastener stringer 11L is separated from the slider 40.

As described above, in the slider 40 of the present embodiment, a length, in the front-rear direction, of the left upper and lower flanges 54*a*, 54*b* of the slider body 50 is shorter than those of the right upper and lower flanges 54*a*, 54*b* of the slider body 50. Accordingly, the parts of the upper and lower blades 51, 52, which are located on the left side with respect to the guide post 53, have a slightly reduced rigidity and thus are configured to be easily bent. Therefore, it is possible to allow the left parts of the upper blade 51 and the lower blade 52 to be easily bent, thereby facilitating separating the separable fastener stringer 11L from the slider 40.

Further, according to the slide fastener 10 of the present embodiment, the cut-out portion 51*b* extending from the left front lateral surface 53*a* of the guide post 53 toward the introduction outside portion is formed on the upper blade 51. Accordingly, the part of the upper blade 51, which is located on the left side with respect to the guide post 53, can be configured to be easily bent. Therefore, it is possible to facilitate separating the separable fastener stringer 11L from the slider 40 by a simple structure.

Further, as shown in FIGS. 6 and 7, the lower blade 52 is formed such that a thickness of one of the left and right parts thereof, on the side of which the cut-out portion 51*b* of the upper blade 51 is formed, is thinner than a thickness of the other of the left and right parts, on the side of which the cut-out portion 51*b* of the upper blade 51 is not formed. Accordingly, the part of the lower blade 52, which is located on one side in the widthwise direction with respect to the guide post 53, is configured to be easily bent, thereby allowing the elements 31 to be easily removed through between the upper and lower flanges 54*a*, 54*b*.

Further, the protrusions 52*g* are formed to protrude downward from the top and bottom end portions and the left end portion of the lower surface 52 of the lower blade 52. Therefore, even if the lower blade 52 is formed to be thin, strength thereof can be maintained. In addition, since the protrusions 52*g* are formed, it is possible to prevent adhesion with another slider 40 upon manufacturing.

As set forth above, the slider 40 of the present embodiment includes a slider body 50 including an upper blade 51 and a lower blade 52 arranged to be spaced from each other in the up-down direction and also to be parallel to each other; a guide post 53 connecting the upper blade 51 and the lower blade 52; and a pull attachment portion 58F, 58R, 70, 80 provided on the upper surface of the upper blade 51; and a pull 60 attached to the pull attachment portion, wherein on a front end portion of a part of the upper blade 51, which is located on one of left and right sides with the guide post 53, a cut-out portion 51*b* is formed to be positioned in the rear of a front end portion 51*a* of a part of the upper blade 51, which is located on the other of the left and right sides with the guide post 53, and also a front end portion 52*a* of the lower blade 52. Thus, according to the slider 40 of the present embodiment, the insertion position of the separable pin 16 can be easily seen and also the lower blade 52 can guide the separable pin 16 and the elements 31. Therefore, the slider 40 according to the present embodiment can achieve a good operability while having a compact and simple structure and also allow the separable pin 16 and the elements 31 to be simply inserted into the slider 40.

Also, in the slider 40 of the present embodiment, a distance T1 from a front end portion 53*c* of the guide post 53 to the cut-out portion 51*b* of the upper blade 51 is longer than a distance T2 from the front end portion 53*c* of the guide post 53 to the front end portion 52*a* of the lower blade 52. Thus, according to the slider 40 of the present embodiment, the insertion position of the separable pin 16 can be more easily seen and thus the separable pin 16 and the elements 31 can be simply inserted into the slider 40.

Further, in the slider 40 of the present embodiment, the distance T2 from the front end portion 53*c* of the guide post 53 to the front end portion 52*a* of the lower blade 52 is zero. Thus, according to the slider 40 of the present embodiment, it is possible to achieve a good operability while having a more compact and simple structure.

Further, in the slider 40 of the present embodiment, the cut-out portion 51*b* is formed to extend from one lateral surface 53*a* of the guide post 53 toward the outside. Thus, according to the slider 40 of the present embodiment, the slider 40 can be simply manufactured.

Further, in the slider 40 of the present embodiment, an upper surface of a part of the lower blade 52, on the side of which the cut-out portion 51*b* is formed, is provided with an inclined portion 52*h* formed to be inclined upward as it goes rearward from the front end portion 52*a*. Thus, according to the slider 40 of the present embodiment, it is possible to guide the separable pin 16 and the elements 31 to the element guide passage 57, thereby allowing the separable pin 16 and the elements 31 to be more simply inserted therein.

Further, in the slider 40 of the present embodiment, an upper surface of the front end portion 52*a* on a part of the lower blade 52, on the side of which the cut-out portion 51*b* is formed, is provided with an introduction inside portion 52*c* formed to be inclined upward as it goes toward the guide post 53; an introduction outside portion 52*d* formed to be inclined upward as it goes toward the outside; and an introduction middle portion 52*b* formed in a recessed shape between the introduction inside portion 52*c* and the introduction outside portion 52*d*. Therefore, according to the slider 40 of the present embodiment, it is possible to guide the separable pin 16 and the elements 31 to the element guide passage 57, thereby allowing the separable pin 16 and the elements 31 to be more simply inserted therein.

Further, in the slider 40 of the present embodiment, the lower blade 52 is formed such that a thickness of one of the left and right parts thereof, on the side of which the cut-out portion 51*b* of the upper blade 51 is formed, is thinner than a thickness of the other of the left and right parts, on the side of which the cut-out portion 51*b* of the upper blade 51 is not formed. Accordingly, the part of the lower blade 52, which is located on one side in the widthwise direction with respect to the guide post 53, can be configured to be easily bent. Therefore, it is possible to more easily separate one fastener stringer 11L from the slider 40.

As set forth above, the slide fastener 10 of the present embodiment includes a fastener chain 11 constituted of a pair of fastener stringers 11L, 11R, wherein the pair of fastener stringers 11L, 11R includes a pair of respective fastener tapes 20 and respective element rows 30, wherein each of the element rows 30 is constituted of a plurality of elements 31 fixed on respective tape side edge portions 20*a* of the pair of fastener tapes 20, wherein the element rows 30 are arranged to oppose each other; and the slider 40 as described above attached to be slidable along the element rows 30 and configured to engage and disengage the elements 31. Thus, according to the slide fastener 10 of the present embodiment, the slider 40 is provided, in which the insertion position of the separable pin 16 can be easily seen and also the lower blade 52 can guide the separable pin 16 and the elements 31. Accordingly, the separable pin 16 and the elements 31 can be simply inserted into the slider 40, which has a compact and simple structure and also a good operability.

Also, the slide fastener 10 of the present embodiment includes a top stop 12 formed an top end of the tape side edge portion 20*a* of each of the pair of fastener tapes 20; and an opener 13 formed on bottom ends of a tape side edge portions 20*a* of the pair of fastener tapes 20. Thus, according to the slide fastener 10 of the present embodiment, the slide fastener 10 can be applied to various products.

Although various embodiments of the present invention have been described, the present invention is not limited to the foregoing embodiments, and accordingly, any other embodiments constructed by appropriately combining configurations of the foregoing embodiments are intended to be encompassed by the scope of the invention.

REFERENCE NUMERALS LIST

10 . . . Slide fastener
11L, 11R . . . Fastener Stringer
12 . . . Top stop
13 . . . Opener
14 . . . Retainer pin
15 . . . Box body
16 . . . Separable pin
20 . . . Fastener tape
20*a* . . . Tape side edge portion
30 . . . Element row
31 . . . Fastener element
40 . . . Slider
50 . . . Slider body
51 . . . Upper blade
51*a* . . . Front end portion
51*b* . . . Cut-out portion
51*d* . . . Insertion direction indicator portion
52 . . . Lower blade
52*a* . . . Front end portion
52*b* . . . Introduction middle portion
52*c* . . . Introduction inside portion
52*d* . . . Introduction outside portion
52*e* . . . Lower surface
52*f* . . . Recess portion
52*g* . . . Protrusion
53 . . . Guide post
53*a* . . . Front lateral surface
53*b* . . . Rear lateral surface
53*c* . . . Front end portion
54*a* . . . Upper flange
54*b* . . . Lower flange
55 . . . Shoulder mouth
56 . . . Rear mouth
57 . . . Guide passage
58F . . . Front attaching post
58B . . . Rear attaching post
59*a*, 59*b* . . . Inclined surface
60 . . . Pull
61 . . . Link portion
70 . . . Stop claw body
71 . . . Stop claw
80 . . . Pull holding cover

The invention claimed is:

1. A slider comprising:

a slider body including an upper blade and a lower blade arranged to be spaced from each other in an up-down direction and to be parallel to each other, a guide post connecting the upper blade and the lower blade, and a pull attachment portion provided on an upper surface of the upper blade; and a pull attached to the pull attachment portion, wherein a cut-out portion is formed on a front end portion of the upper blade at one of left and right sides with respect to the guide post, the cut-out portion is formed to be positioned at a rear side of the front end portion of the upper blade at the other of the left and right sides with respect to the guide post and of a front end portion of the lower blade at the one of the left and right sides with respect to the guide post.

2. The slider according to claim 1, wherein a distance from a front end portion of the guide post to the cut-out portion of the upper blade is longer than a distance from the front end portion of the guide post to the front end portion of the lower blade.

3. The slider according to claim 2, wherein the distance from the front end portion of the guide post to the front end portion of the lower blade is zero.

4. The slider according to claim 1, wherein the cut-out portion is formed to extend from one lateral surface of the guide post toward the outside.

5. The slider according to claim 1, wherein an upper surface of the lower blade, on a side at which the cut-out portion is formed, is provided with an inclined portion formed to be inclined upward as it goes rearward from the front end portion.

6. The slider according to claim 1, wherein an upper surface of the front end portion of the lower blade, on a side at which the cut-out portion is formed, is provided with:

an introduction inside portion formed to be inclined upward as it goes toward the guide post;

an introduction outside portion formed to be inclined upward as it goes toward the outside; and an introduction middle portion formed in a recessed shape between the introduction inside portion and the introduction outside portion.

7. The slider according to claim 1, wherein the lower blade is formed such that a thickness of one of left and right parts thereof, on a side at which the cut-out portion of the upper blade is formed, is thinner than a thickness of the other of the left and right parts, on a side at which the cut-out portion of the upper blade is not formed.

8. A slide fastener comprising:

a fastener chain in which a pair of fastener stringers including a pair of respective fastener tapes and respective element rows constituted of a plurality of elements fixed on respective tape side edge portions of the pair of fastener tapes are arranged so that the element rows are arranged to oppose each other; and a slider including:

a slider body including an upper blade and a lower blade arranged to be spaced from each other in an up-down direction and to be parallel to each other, a guide post connecting the upper blade and the lower blade, and a pull attachment portion provided on an upper surface of the upper blade; and a pull attached to the pull attachment portion, wherein a cut-out portion is formed on a front end portion of the upper blade at one of left and right sides with respect to the guide post, and the cut-out portion is formed to be positioned at a rear side of the front end portion of the upper blade at the other of the left and right sides with respect to the guide post and of a front end portion of the lower blade, at the one of the left and right sides with respect to the guide post, and wherein the slider is attached to be slidable along the element rows and configured to engage and disengage the elements.

9. The slide fastener according to claim 8, further comprising:

a top stop formed an top end of the tape side edge portion of each of the pair of fastener tapes; and an opener formed on bottom ends of a tape side edge portions of the pair of fastener tapes.

* * * * *